United States Patent [19]

Ichikawa et al.

[11] 4,135,413

[45] Jan. 23, 1979

[54] DEVICE OR ARRANGEMENT OF PARTS FOR ELASTICALLY LOADING MOVABLE MEMBER

[75] Inventors: Hisashi Ichikawa, Katsuta; Kenji Ogiro, Yokohama, both of Japan

[73] Assignee: Hitachi, Ltd., Japan

[21] Appl. No.: 837,158

[22] Filed: Sep. 28, 1977

[30] Foreign Application Priority Data

Sep. 29, 1976 [JP] Japan ..... 51-129947[U]

[51] Int. Cl.[2] ..... G05G 5/06

[52] U.S. Cl. ..... 74/529

[58] Field of Search ..... 74/529, 532, 527; 274/11 F

[56] References Cited

U.S. PATENT DOCUMENTS

| | | | |
|---|---|---|---|
| 2,525,846 | 10/1950 | Wilson | 74/532 |
| 2,664,755 | 1/1954 | Kiel | 74/532 X |
| 2,895,347 | 7/1959 | Reid | 74/529 X |
| 2,917,944 | 12/1959 | Hills | 74/529 X |

*Primary Examiner*—Leonard H. Gerin
*Attorney, Agent, or Firm*—Craig & Antonelli

[57] ABSTRACT

A device or arrangement of parts for electrically loading a movable member so as to bias same in one direction. In this device, an elastic member is secured to a pivot provided on a base member, with its two arms being deflected and then held by first and second locking members, after which a movable member is forced down against the elastic member from above, so that a guide portion of the movable member may push one arm of the elastic member so as to keep the arm apart from the locking member which locks the arm, and then a locking portion continuous with the guide portion, of the movable member locks the arm. As a result, the movable member is elastically loaded so as to bias in one direction, while the movement of the movable member is limited by means of a control member provided on the base member.

5 Claims, 5 Drawing Figures

DEVICE OR ARRANGEMENT OF PARTS FOR ELASTICALLY LOADING MOVABLE MEMBER

LIST OF PRIOR ART REFERENCES (37 CFR 1.56 (a))

Japanese Utility Model Laid-Open Publication No. 67705/76 published on May 28, 1976

BACKGROUND OF THE INVENTION

1. Field of the Invention

This invention relates to a device or arrangement of parts suited for elastically loading a movable member so as to bias same in one direction.

2. Description of the Prior Art

In electronic equipment industry, it has been a common practice to use a device for elastically loading a pivotally movable member so as to bias same in one direction under the action of an elastic member. For instance, such an operating member is used in a tape recorder, which may be locked in an operated position, when operated for the first time for causing a magnetic tape to travel or for controlling travelling of the tape, and then released from its locked position so as to return to its non-operated position, when operated next. To this end, an elastic member is provided for an operating member so as to load the operating member to return same to its non-operated position. In case the operating member is used for the purpose of pausing the travelling of a tape, the operating member dictates the exclusive use of a locking rotatable member so that when the operating member is operated for the first time, the operating member may be locked in its operated position, and then released from its locked position so as to return to its non-operated position, when operated next, due to the pivotally movable member being elastically loaded so as to turn in a given direction.

In this respect, for elastically loading the movable member to bias same in a given direction, the elastic member is deflected to some extent, upon attaching thereof, to exert an elastic force to a member required.

Hitherto, it has been customary that, upon attaching, a movable member is secured in a given position, and then an elastic member is locked to the movable member, while being deflected to some extent upon attaching thereof, thereby loading the movable member so as to bias same in a given direction. As a result, a complicated operation is required for attaching of the elastic member, and hence skill is required for attaching the elastic member manually. Furthermore, the automation of attaching an elastic member results in the need to provide sophisticated equipments which allow the complicated attitude-control of the elastic member.

SUMMARY OF THE INVENTION

It is accordingly an object of the present invention to provide a device or arrangement of parts which may be installed or secured in a simple manner and may elastically load a movable member so as to bias same in a given direction.

According to the present invention, an elastic member is deflected beforehand and then locked in position on a base member, after which a movable member to engage the elastic member is only forced against the elastic member so as to cause the elastic member to be locked to the movable member.

DESCRIPTION OF THE PREFERRED EMBODIMENT

Figure 1:
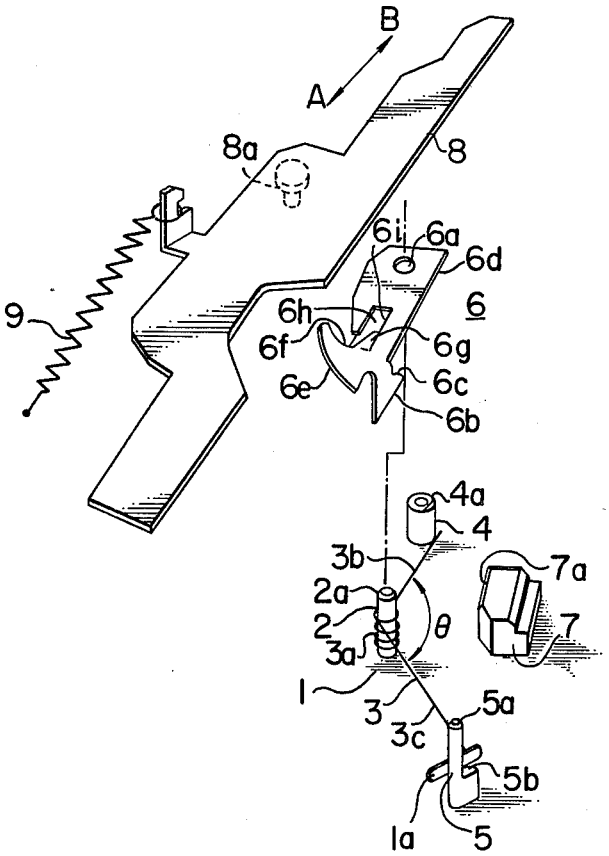
FIG. 1 is an exploded perspective view of one embodiment of the invention.
Figure 4:
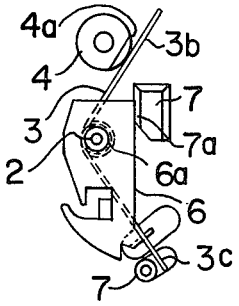
FIG. 4 is a plan view of essential part of the embodiment after being attached.
Figure 5:
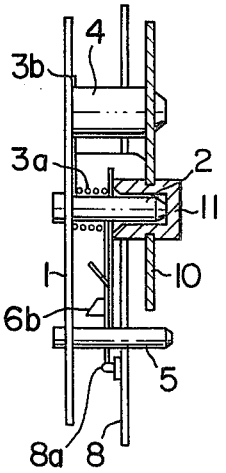
FIG. 5 is a side view of the embodiment after being attached.
Figure 2:
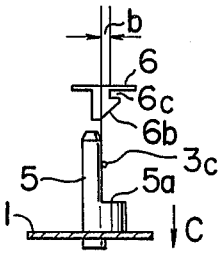
FIG. 2 is a partial side view of the embodiment of FIG. 1.
Figure 3:
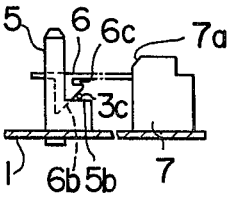
FIG. 3 is a partial side view of the embodiment in the course of attaching operation.

A pivot 2 is provided on a base member 1, while a center coiled portion 3*a* of coil spring 3 is fitted on the pivot 2. One arm 3*b* of the spring 3 is locked by a locking member 4 provided on the base member 1, while the other arm 3*c* of the spring 3 is locked by another locking member 5 provided on the base member 1. The spring 3 has two arms 3*b*, 3*c* deflected through an angle $\theta$ and so retained by the locking members 4, 5. The top faces of the pivot 2, locking members 4, 5 above the spring 3 are inclined so as to provide inclined surfaces 2*a*, 4*a*, 5*a*, respectively.

For attaching the spring 3, the two arms 3*b*, 3*c* are deflected through an angle $\theta$ and the coiled portion 3*a* is fitted on the pivot 2, while one arm 3*b* is locked by the locking member 4, and the other arm 3*c* is locked by another locking member 5, respectively. The inclined surfaces 2*a*, 4*a*, 5*a* function so as to guide the spring 3 to its proper positions relative to the members 2, 4, 5, even if the spring 3 is slightly deviated from intended positions relative to members 2, 4, 5, when fitted on the pivot 2 in the aforesaid manner.

A pivotally movable member 6 is attached in position by being pushed down onto the spring 3 from above. The pivotally movable member 6 is provided with a hole 6*a*, into which the pivot 2 is fitted therein, a guide portion 6*b* having an inclined surface on the side opposite to the hole 6*a*, and a locking portion 6*c* continuous with the guide portion 6*b*. In this respect, the locking portion 6*c* is provided in the form of a stepped portion. The guide portion 6*b* and locking portion 6*c* are provided as a lower bent portion of the member 6, which is directed at a right angle to such a main surface of the member 6 which includes the hole 6*a*. In addition, the hole 6*a* is positioned so as to face the pivot 2 to be fitted thereon, and the inclined edge of the guide portion 6*b* is so designed as to face the arm 3*c* of the spring 3 which is positioned close to the locking member 5. A hole 6*a* adapted to admit the inclined portion 6*b* is provided in the base member 1 so as to face the inclined portion 6*b*. Provided on the base member 1 in a position close to the pivot 2 is a control member 7, which faces a side edge 6*d* of the pivotally movable member 6 so as to limit the clockwise rotation of the member 6. The control member 7 also serves as a guide for the pivotally movable member 6, when the member 6 is pushed down to its proper position, while an inclined, top surface 7*a* thereof serves to guide the pivotally movable member 6 so as to be positioned properly, when attached.

After the spring 3 has been forced down to be attached in position, the pivotally movable member 6 is forced towards the base member 1, with the hole 6*a* thereof facing the pivot 2. Then, the hole 6*a* is fitted on the pivot 2, and the inclined edge of the guide portion 6*b* abuts the arm 3*c* of the spring 3. When the pivotally movable member 6 is further forced down, the inclined edge of the guide portion 6*b* pushes the arm 3*c* to bring same into abuttment with a position-limiting portion 5*b* which is formed on the locking member 5 and directed horizontally, so that the arm 3*c* is moved along the member 5*b* in the direction away from the locking member 5, following the contour of the inclined edge of the guide portion 6*b*. Eventually, the arm 3*c* is locked by the stepped portion of the locking portion 6*c* continuous with the inclined portion 6*b*. At this time, the arm 3*c* tends to return towards the locking member 5. However, the arm 3*c* is retained a distance b apart from the locking member 5 according to the contour of the locking member 6*c*. Accordingly, the pivotally movable member 6 is so loaded as to turn clockwise under the action of the spring 3, while the side edge 6*d* positioned close to the hole 6*a* abuts the control member 7 and is so located.

An operating member 8 for pausing a tape recorder is placed above the pivotally movable member 6 so as to slide in the A-B direction, and elastically loaded by a tension spring 9 provided between the operating member 8 and the base member 1 so as to be biased to the non-operated direction. A pin member 8*a* is formed on the operating member 8 in opposed relation to the pivotally movable member 6.

In this respect, the spring 3 is a torsion and compression coil spring, while a cylindrical member 11 secured to an attaching member 10 is fitted on the pivot 2 from above the coiled portion 3*a*. The cylindrical member 11 compresses the coiled portion 3*a* of the spring 3 to some extent against an axial tension thereof to a given lowered position.

The pin member 8*a* of the slidable operating member 8 is locked by the pivotally movable member 6 in its operated position due to operation of the operating member 8 in the direction B, and then released from its locked condition, when the operating member 8 is operated next. To this end, the pivotally movable member 6 includes an inclined edge 6*e* opposite to the hole 6*a*, and internal, guiding-side-edge 6*f* continuous therewith, a bent portion 6*g*, and a cut-away portion 6*h* facing the bent portion 6*g*. Due to the first operation of the operating member 8 in the direction B, the pin member 8*a* pushes the inclined edge 6*e* against an elastic force of the spring which acts thereon, so as to turn the pivotally movable member 6 counterclockwise, and then returns to the initial position along the internal guide edge 6*f* under a returning action of the spring 3, then abuts the bent portion 6*g*, thereby locking the operating member 8 in its operated position. Due to the second operation of the operating member 8 in the direction B, the pin member 8*a* is detached from the bent portion 6*g* into the cut-away portion 6*h*, whereupon the pivotally movable member 6 is turned in the initial direction under a returning action of the spring 3 and then abuts the side edge 6*i* of the cut away portion 6*h*. Then, when a hand is put off the operating member 8, then the pin member 8*a* slides on the bent portion 6*g* so as to return in the direction A, while compressing the coiled portion 3*a* of the spring 3 under a returning action of the spring 9 in a manner to lower the bent portion 6*g*, so that the pin member 8*a* is released from its locked condition. At this time, the bent portion 6*g* returns to its non-operated position under an axial returning action of the spring 3.

While description has been had thus far to one embodiment of the invention, it should be understood that various modifications and alterations are possible within the scope of the invention. For instance, a coil spring may be so designed as to load a pivotally movable member so as to only effect pivotal movement. Otherwise, the pivotally movable member may be merely a slidable operating member, and a member for elastically loading the movable member should not necessarily be limited to a coil spring, but may be any type elastic member.

What is claimed is:

1. A device or arrangement of parts for elastically loading a movable member, comprising:
   (a) an elastic member having a central portion and two arms extending therefrom in opposite directions;
   (b) a pivot, on which said central portion of said elastic member is fitted, with said two arms of said elastic member being deflected;
   (c) a first locking member for locking one of said arms which are deflected;
   (d) a second locking member for locking the other of said arms which are deflected;
   (e) a movable member including (i) a guide portion which faces one of said arms, and pushes said arm so as to release said arm from its locking member associated therewith, and (ii) a locking portion continuous with said guide portion for locking said arm pushed by said guide portion, in a position away from said locking member, said movable member being elastically loaded by said elastic member; and
   (f) a control member for abutting said movable member to limit the displacement of said movable member due to an elastic force of said elastic member.

2. A device or arrangement of parts as defined in claim 1, wherein said elastic member is a coil spring including a central portion or coiled portion, and two arms extending from said coiled portion in the opposite directions.

3. A device or arrangement of parts as defined in claim 1, wherein said movable member is a pivotally movable member which may be turned or rotated, and a hole provided therein on one side thereof is fitted on said pivot, while said guide portion and said locking portion are provided on the other side.

4. A device or arrangement of parts as defined in claim 1, wherein said guide portion and said locking portions are provided in the form of a bent portion which is bent from the main plane of said movable member towards said elastic member, said guide portion facing one of said arms.

5. A device or arrangement of parts as defined in claim 1, wherein the top faces of said pivot, said first and second locking members are inclined so as to guide said elastic member, when said elastic member is attached in position from above said pivot, and said first and second locking members.

* * * * *